United States Patent [19]

Thomas, Sr.

[11] Patent Number: 5,073,095

[45] Date of Patent: Dec. 17, 1991

[54] WHISPER QUIET ELECTROMAGNETIC FLUID PUMP

[75] Inventor: James A. Thomas, Sr., Corning, N.Y.

[73] Assignee: Purolator Product Company, Tulsa, Okla.

[21] Appl. No.: 506,935

[22] Filed: Apr. 10, 1990

[51] Int. Cl.[5] ..... F04B 17/04

[52] U.S. Cl. ..... 417/417; 335/257

[58] Field of Search ..... 335/257; 417/417

[56] References Cited

U.S. PATENT DOCUMENTS 3,381,616 5/1968 Wertheimer et al. .
3,556,684 1/1971 Rouquette .
4,079,436 3/1978 Brown .
4,306,843 12/1981 Arai .
4,725,208 2/1988 Brown ..... 417/417
4,832,583 5/1989 Brown .

*Primary Examiner*—Gerald A. Michalsky
*Attorney, Agent, or Firm*—Remy J. VanOphem

[57] ABSTRACT

An electromagnetic reciprocating piston fluid pump having a housing defining a piston guide, an inlet port, and an outlet port, and a piston disposed in the piston guide. A blocking oscillator periodically energizes a solenoid coil to reciprocate the piston in the piston guide and valves provide for unidirectional fluid flow through the pump. A soft rubber bumper and a semi-rigid plastic washer are disposed at the output end of the piston guide to noiselessly terminate the displacement of the piston at the end of its pumping stroke.

10 Claims, 1 Drawing Sheet

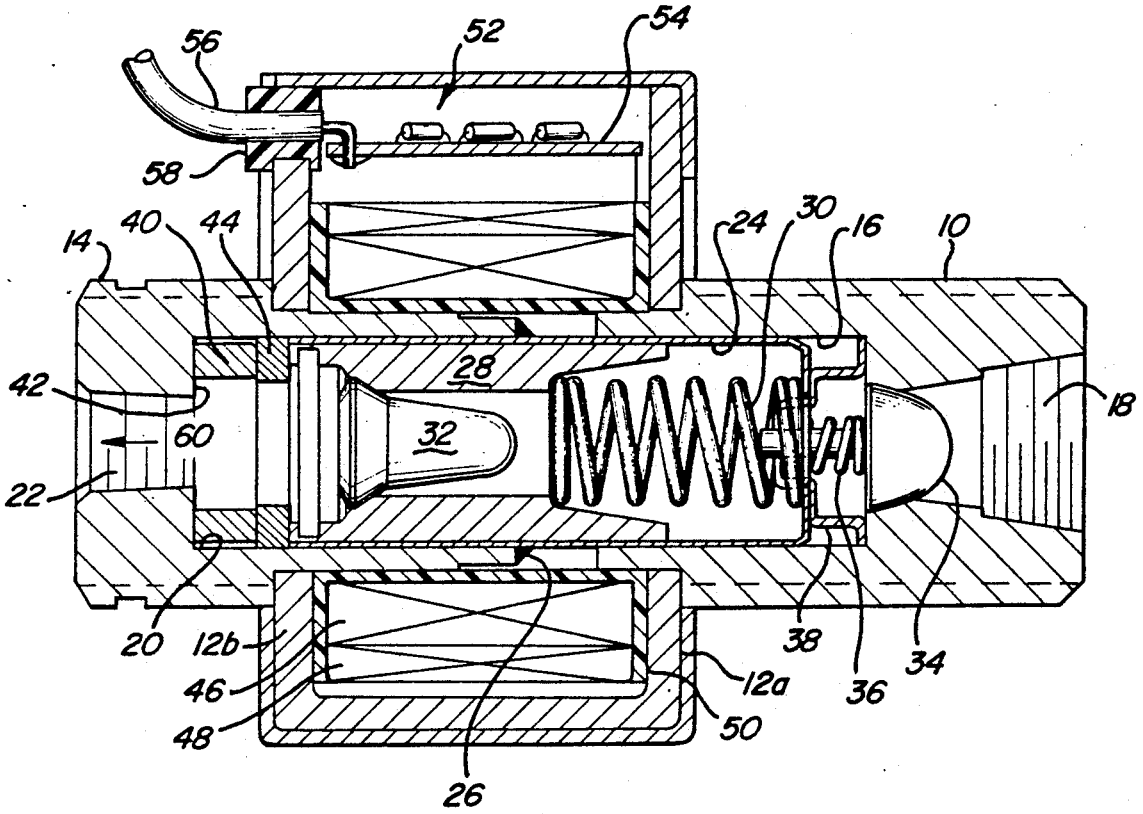
56
52
54
58
14
40
44
24
30
16
10
42
28
18
60
32
22
20
12b
38
34
46
12a
36
48
50
26

WHISPER QUIET ELECTROMAGNETIC FLUID PUMP

BACKGROUND OF THE INVENTION

1. Field of the Invention

The invention is related to the field of electromagnetic fluid pumps and in particular to a quiet electromagnetic reciprocating piston fluid pump.

2. Description of the Prior Art

Reciprocating piston electromagnetic fluid pumps for the most part are quite noisy, especially under light loads due to the reciprocating piston hammering against the output end of the housing. One approach to reduce the hammering is to insert a coil spring between the housing and the piston as taught by Wertheimer et al in U.S. Pat. No. 3,381,616; Rouquette in U.S. Pat. No. 3,556,684; and Arai in U.S. Pat. No. 4,306,843. Although the springs taught therein reduced the piston's hammering force at the end of the pumping stroke, they were not entirely successful in reducing the noise generated by these types of pumps. An alternate approach is taught by Brown in U.S. Pat. No. 4,079,436, in which a resilient washer is attached to the end of the housing to absorb the hammering of the piston against the housing at the end of the pumping stroke. Because of the direct engagement of the piston with the resilient washer, the washer had to be made from a rather hard resilient material (Nylon) so that it would have a satisfactory life expectancy. Softer rubber washers were subject to distortion and degradation by the constant hammering of the piston and their life expectancy was too short for practical applications.

Brown, in U.S. Pat. No. 4,832,583, discloses a rubber bumper seal for a low pressure metering pump. The bumper seal is attached to the end of the piston and occludes the outlet port at the end of the piston guide when the solenoid is deenergized and the piston is displaced to its extreme position at the end of the pumping stroke. The sealing of the port at the end of the piston guide prevents fluid from being back-siphoned through the pump.

SUMMARY OF THE INVENTION

The invention is an electromagnetic fluid pump having a housing which has an inlet port, an outlet port, and a cylindrical piston guide connecting the inlet port to the outlet port. A magnetically susceptible piston is disposed in the piston guide and means are provided for reciprocating the piston between a first position adjacent the inlet port and a second position adjacent the outlet port. Valve means associated with the piston guide and piston provide for unidirectional fluid flow through the pump in response to the reciprocation of the piston. A resilient annular rubber bumper is provided at the end of the piston guide adjacent to the inlet port and a semi-rigid plastic annular washer is disposed between the annular rubber bumper and the piston. The semi-rigid plastic annular washer is displaced by the piston toward the outlet port as the piston approaches its second position and applies a uniform compressive force on the rubber bumper to noiselessly terminate the displacement of the piston at the end of the pumping stroke.

The object of the invention is to significantly reduce the noise generated by the electromagnetic pump caused by the piston hammering against the end of the housing.

Another object of the invention is the use of a semi-rigid, plastic washer between a rubber bumper and the piston to uniformly distribute the force of the piston on the rubber bumper.

Still another object of the invention is the use of a soft rubber bumper, to noiselessly terminate the pumping stroke of an electromagnetic reciprocating piston fluid pump.

These and other objects of the invention will become more apparent from a reading of the detailed description of the invention in conjunction with the drawing.

BRIEF DESCRIPTION OF THE DRAWING

FIG. 1 is a cross-sectional side view of an electromagnetic fluid pump embodying the noise absorbing rubber bumper and semi-rigid plastic washer.

DETAILED DESCRIPTION OF THE PREFERRED EMBODIMENT

A cross-sectional view of the "whisper quiet" electromagnetic pump is shown in FIG. 1. The "whisper" electromagnetic pump is structurally similar to the electromagnetic pump illustrated and described in U.S. Pat. No. 4,079,436. The electromagnetic pump has an input housing member 10 which is threaded onto an input pole member 12*a* and an output housing member 14 which is threaded onto an output pole member 12*b* in axial alignment with the input housing member 10. The input housing member 10 has a cylindrical cavity 16 which is connected to an axially disposed inlet port 18. The output housing member 14 has a cylindrical cavity 20 which is connected to an axially disposed outlet port 22. The inlet port 18 and outlet port 22 may be threaded as shown to facilitate the connection of a fluid connector thereto. The cylindrical cavities 16 and 20 have the same diameter and are axially aligned with each other.

A non-magnetic cylindrically shaped piston guide 24 is disposed in the cylindrical cavity 20 and extends into the cylindrical cavity 16. The external surface of the piston guide 24 is sealingly attached to the output housing member 14 at an internal end of the output housing member, as shown, by soldering, brazing, welding, or any other method known in the art.

A magnetically susceptible hollow piston 28 is slidably disposed in the piston guide 24 and is free to reciprocate therein between a first position adjacent to the outlet port 22 and a second position adjacent to the inlet port 18. The piston 28 is resiliently biased towards the first position adjacent to the outlet port by a coil spring 30. A first check valve member 32 is provided at the end of the piston 28 adjacent to the outlet port 22 and a second check valve member 34 is provided adjacent to the inlet port 18. A coil spring 36 disposed between the second check valve member 34 and a valve guide 38 biases the second check valve member 34 to a closed position adjacent a valve seat formed at the internal end of the inlet port 18. As is known in the art, the first and second check valve members 32 and 34 provide for unidirectional fluid flow through the pump with the reciprocation of the piston 28. The valve guide 38 is biased toward the inlet port 18 by the coil spring 30.

An annular rubber bumper 40 is disposed in the cylindrical cavity 20 and abuts an end wall 42 of the cylindrical cavity 20 adjacent to the outlet port 22. An annular semi-rigid plastic washer 44, preferably made from Nylon, is disposed in the cylindrical cavity 20 between the end of the piston guide 24 and the annular rubber bumper 40. The internal diameter of the annular semi-rigid plastic washer 44 is preferably smaller than the internal diameter of the annular rubber bumper 40 to prevent deformation of the annular rubber bumper 40 into the hollow portion of the piston 28 when the annular rubber bumper is compressed by the piston 28 at the end of the pumping stroke. As is shown, the external diameter of the annular rubber bumper 40 is preferably smaller than the internal diameter of the cylindrical cavity 20 so that the annular rubber bumper may radially expand in both directions when compressed by the annular semi-rigid plastic washer 44. The annular semi-rigid plastic washer 44 also more uniformly applies the pressure exerted by the piston 28 on the mating surface of the annular rubber bumper 40 and eliminates deformation and wear. The annular semi-rigid plastic washer 44 also permits the use of a softer rubber elastomeric material, such as VITON®, for the rubber bumper.

A solenoid coil 46 and a detection coil 48 are wound on a coil spool 50. The coil spool 50 circumscribes the piston guide 24 in the space between the input and output pole members **12*a* and 12*b*. The solenoid coil 46 is periodically energized by an oscillator circuit 52 mounted on a circuit board 54. The oscillation frequency of the oscillator circuit 52 is controlled by a control signal induced in the detection coil 48 by the solenoid coil 46. The oscillator circuit 52 may be a blocking oscillator of the type shown in U.S. Pat. Nos. 4,079,436 or 3,381,616 or may be any other similar type of oscillator circuit which produces an output signal periodically energizing the solenoid coil 46. Electrical power is supplied to the oscillator circuit 52 and the solenoid coil 46 by means of an electrical wire 56 having one end electrically connected to the circuit board 54. The electrical wire is insulated from the input pole member by a rubber grommet 58**.

In operation, the oscillator circuit 52 in response to the control signal induced in the detection coil 48 periodically energizes the solenoid coil 46 to generate a magnetic field. The magnetic field produces a force urging the piston 28 towards the inlet port 18. The coil spring 36 holds the second check valve member 34 in the closed position, but the first check valve member 32 is displaced to the open position, permitting only the piston 28 to be displaced toward the inlet port 18 against the force of the coil spring 30. After a period of time determined by the oscillator circuit 52, the solenoid coil 46 is deenergized and the coil spring 30 urges the piston toward the outlet port 22. As the piston 28 moves toward the outlet port, the first check valve member 32 moves to the closed position and a portion of the fluid trapped between the closed first check valve member 32 and the outlet port 22 is pushed out of the outlet port in the direction shown by arrow 60. The second check valve member 34 opens, permitting fluid to enter the pump through the inlet port 18 as the piston 28 moves toward the outlet port.

Near the end of the pumping stroke, the piston 28 engages the annular semi-rigid plastic washer 44 and will then displace the annular semi-rigid plastic washer 44 until it reaches the end of the pumping stroke or second position. The annular rubber bumper 40 will be resiliently compressed by the displacement of the annular semi-rigid plastic washer 44, eliminating the mechanical noise generated by the pumps having the structure as taught by the prior art. As previously indicated, the annular semi-rigid plastic washer 44 prevents metal-to-metal contact at the end of the pumping stroke. The annular semi-rigid plastic washer also prevents undesirable deformation of the annular rubber bumper 40 which could lead to pump failure. The annular semi-rigid plastic washer 44 also applies a uniform force against the sides of the annular rubber bumper 40 to ensure uniform compression and return of the annular rubber bumper to its original shape and permits the annular rubber bumper 40 to be made from a softer resilient material, which accounts for the significant noise reduction of the "whisper quiet" pump over comparable electromagnetic fluid pumps.

It is recognized that this noise reduction concept may be applied to other reciprocating piston fluid pumps within the scope of the invention as illustrated in the drawings, discussed in the specification, and set forth in the appended claims.

What is claimed is:

1. A fluid pump comprising:

a housing having a cylindrically shaped piston guide, an inlet port at one end of said cylindrically shaped piston guide and an outlet port at the other end of said cylindrically shaped piston guide;

a piston disposed in said cylindrically shaped piston guide between said inlet and said outlet ports;

means for reciprocating said piston in said cylindrically shaped piston guide between a first position adjacent to said inlet port and a second position adjacent to said outlet port;

valve means cooperating with said cylindrically shaped piston guide and said piston for providing a unidirectional fluid flow through said cylindrically shaped piston guide from said inlet port to said outlet port in response to said reciprocation of said piston, said valve means being mounted to said piston;

a resilient annular bumper provided at the end of said cylindrically shaped piston guide adjacent to said outlet port; and a semi-rigid annular plastic washer disposed between said resilient annular bumper and said piston, said semi-rigid annular plastic washer being displaced by said piston toward said outlet port as said piston approaches said second position and applying a uniform compressive force on said resilient annular bumper whereby any hammering noise associated with the impact of said semi-rigid annular plastic washer by said piston as said means for reciprocating said piston moves said piston from said first position to said second position is absorbed by said resilient annular bumper.

2. The fluid pump of claim 1 wherein said piston is a magnetically susceptible piston and wherein said means for reciprocating said piston comprises:

a solenoid coil circumscribing said cylindrically shaped piston guide;

oscillator means for periodically energizing said solenoid coil to displace said magnetically susceptible piston to said first position; and resilient means for displacing said piston from said first position to said second position when said solenoid coil is deenergized.

3. The fluid pump of claim 2 wherein said housing comprises:

an input pole member;

an output pole member spaced from said input pole member;

an input housing member attached to said input pole member, said input housing member having said inlet port and a first cylindrical cavity connected to said inlet port;

an output member attached to said output pole member, said output member having said outlet port and a second cylindrical cavity axially aligned with said first cylindrical cavity connected to said outlet port; and a non-magnetic cylinder having one end disposed in said second cylindrical cavity and a second end extending into said first cylindrical cavity, said non-magnetic cylinder constituting said cylindrically shaped piston guide.

4. The fluid pump of claim 3 wherein said second cylindrical cavity has an annular internal end wall adjacent to said outlet port and said resilient annular bumper is disposed between said annular internal end wall and said one end of said non-magnetic cylinder.

5. The fluid pump of claim 4 wherein said semi-rigid annular plastic washer is disposed between said resilient annular bumper and said one end of said non-magnetic cylinder.

6. The fluid pump of claim 5 wherein said resilient annular bumper has an internal diameter and said semi-rigid annular plastic washer has an internal diameter smaller than the internal diameter of said resilient annular bumper.

7. In combination with an electromagnetic fluid pump having a magnetically susceptible piston disposed in a non-magnetic piston guide, an inlet port provided at an opposite end of said piston guide and an outlet port provided at the other end of said piston guide, a solenoid coil circumscribing said piston guide, a detection coil magnetically coupled to said solenoid coil, an oscillator responsive to the signal induced in said detection coil by said solenoid coil to periodically energize said solenoid coil to produce a magnetic field displacing said piston to a first position adjacent to said inlet port, resilient means for displacing said piston to a second position adjacent to said outlet port, and valve means for providing unidirectional flow of fluid from said inlet port through said outlet port as said piston travels from said first position towards said second position, an improvement comprising:

an annular rubber bumper disposed between said outlet port and said opposite end of said piston guide; and a semi-rigid annular plastic washer disposed between said annular rubber bumper and said piston, said semi-rigid annular plastic washer applying a uniform compressive force on said annular rubber bumper as said piston approaches said second position whereby any hammering noise associated with the impact of said semi-rigid annular plastic washer by said piston as said means for reciprocating said piston moves said piston from said first position to said second position is absorbed by said resilient annular bumper.

8. The improvement of claim 7 wherein said semi-rigid annular plastic washer is disposed between said annular rubber bumper and said opposite end of said piston guide.

9. The improvement of claim 8 wherein said annular rubber bumper has a first internal diameter, said semi-rigid annular plastic washer has a second internal diameter smaller than said first internal diameter.

10. An electromagnetic fluid pump comprising:

a housing having an inlet port, an outlet port, and a cylindrically shaped piston guide disposed between said inlet port and said outlet port;

a piston disposed in said cylindrically shaped piston guide, said piston being reciprocal between a first position adjacent said outlet port and a second position adjacent said inlet port;

a solenoid coil operative to generate a magnetic field displacing said piston from said first position to said second position;

a detection coil magnetically linked to said solenoid coil to generate a control signal;

blocking oscillator means for periodically energizing said solenoid coil to generate said magnetic field in response to said control signal;

resilient means for displacing said piston from said second position to said first position;

valve means for providing a uniform fluid flow through said electromagnetic fluid pump in response to the reciprocation of said piston in said cylindrically shaped piston guide, said valve means being mounted to said piston;

a resilient annular rubber bumper disposed in said housing adjacent to said outlet port; and a semi-rigid annular plastic washer disposed in said housing between said resilient annular rubber bumper and said piston, said semi-rigid annular plastic washer being displaced by said piston as said piston approaches said second position and applying a uniform compressive force on said resilient annular rubber bumper to noiselessly terminate the displacement of said piston at said second position whereby any hammering noise associated with the impact of said semi-rigid annular plastic washer by said piston as said piston moves from said first position to said second position is absorbed by said resilient annular rubber bumper.

* * * * *

UNITED STATES PATENT AND TRADEMARK OFFICE

CERTIFICATE OF CORRECTION

PATENT NO. : 5,073,095

DATED : December 17, 1991

INVENTOR(S) : James A. Thomas, Sr.

It is certified that error appears in the above-identified patent and that said Letters Patent is hereby corrected as shown below:

Column 2, line 21, after "whisper" insert ---- quiet ----.

Signed and Sealed this

Sixth Day of April, 1993

*Attest:*

STEPHEN G. KUNIN

*Attesting Officer*

*Acting Commissioner of Patents and Trademarks*